US006793499B1

(12) United States Patent
Chen

(10) Patent No.: US 6,793,499 B1
(45) Date of Patent: Sep. 21, 2004

(54) ROTATABLE ELECTRICAL PLUG

(76) Inventor: Tsang-I Chen, Room 707, No. 293, Sung Chiang Rd., Taipei (TW)

( * ) Notice: Subject to any disclaimer, the term of this patent is extended or adjusted under 35 U.S.C. 154(b) by 0 days.

(21) Appl. No.: 10/633,539

(22) Filed: Aug. 5, 2003

(51) Int. Cl.[7] ..... H01R 39/00
(52) U.S. Cl. ..... 439/13; 439/21
(58) Field of Search ..... 439/11, 134, 20, 439/21, 22–28, 640

(56) References Cited

U.S. PATENT DOCUMENTS 5,399,093 A 3/1995 Schneider et al.
5,775,921 A 7/1998 Chou
6,089,921 A * 7/2000 Chou ..... 439/640
6,595,782 B1 * 7/2003 Hsiao ..... 439/13

* cited by examiner

*Primary Examiner*—Truc Nguyen
*Assistant Examiner*—James R. Harvey
(74) *Attorney, Agent, or Firm*—Browdy and Neimark, P.L.L.C.

(57) ABSTRACT

A rotatable electrical plug includes a housing having an opening and a wire hole, a rotary prong holder pivotally coupled to the opening in the housing to hold hot, neutral and grounding prongs, two annular metal contact members concentrically mounted on the rotary prong holder and respectively soldered to the hot and grounding prongs, and three connecting members mounted in a substrate inside the housing for the connection of hot, neutral, and grounding wires of an power cord and respectively disposed in contact with the metal annular contact members and the neutral prong.

15 Claims, 5 Drawing Sheets

ROTATABLE ELECTRICAL PLUG

BACKGROUND OF THE INVENTION

1. Field of the Invention

The present invention relates generally to electrical plugs for electric appliances and, more particularly, to a rotatable electrical plug.

2. Description of the Related Art

The conventional electrical plug of the power cord of an electrical appliance is not rotatable relative to the power cord. When inserted into an electrical socket, the hard electrical plug is firmly held in place; however the flexible power cord may curve subject to external force. When using a portable electric appliance, for example, a vacuum cleaner, air dryer, electric hand tool or the like, the power cord may be stretched frequently, and the electric connection between the power cord and the electrical plug tends to be broken, resulting in a short circuit.

U.S. Pat. No. 5,399,093 and U.S. Pat. No. 5,775,921 both provide a rotatable electrical plug, in which a rotative connection is provided between the power cord and the prongs, so that the housing can be biased subject to the position change of the electric appliance after connection of the electrical plug to an electrical socket. According to these designs, a rotative coupling device with concentrically arranged annular contacts provides the rotative connection between the power cord and the prongs. The main drawback of these designs is the complicated connection structure between the power cord and the rotative coupling device. According to U.S. Pat. No. 5,399,093, annular conductors 52 are electrically connected to respective ones of the power cord conductors 48 via connection arms 80*a*, 80*b*, 80*c* which extend from annular conductors 52, each connection arm 80 terminating in a wire crimp 82*a*, 82*b*, 82*c* which attaches the respective connection arm to a respective power cord conductor 48. According to U.S. Pat. No. 5,775,921, connection tip 191 is provided at the annular metal cushion, and side openings 133, 134, 183 are respectively formed in the upright annular flanges 13, 18 for the passing of electric wires 21, 22, 23. The complicated structural design greatly increases the manufacturing cost of the electrical plug.

Further, the aforesaid two prior art designs use spring means (arcuate and linear spring contacts 54*a*, 54*b*, 54*c* in U.S. Pat. No. 5,399,093) to enhance the reliability of the connection between the power cord and the prongs. The spring means simply complicates the structure without providing any added function.

Therefore, it is desirable to provide a rotatable electrical plug that eliminates the aforesaid drawbacks.

SUMMARY OF THE INVENTION

It is the primary object of the present invention to provide a rotatable electrical plug, which prevents distortion of the power cord of the electric appliance, prolonging the service life of the product and ensuring the safety of the use of electric appliance.

It is another object of the present invention to provide a rotatable electrical plug, which has a simple structure and is inexpensive to manufacture, and easy to install.

To achieve these objects of the present invention the rotatable electrical plug comprises a housing having an inner cover shell, an outer cover shell abutted against the inner cover shell, a wire hole, an opening formed in the inner cover shell, and a substrate provided inside the outer cover shell. A rotary prong holder is mounted inside the housing and rotatably coupled to the opening in the inner cover shell. At least two prongs are respectively fastened to the rotary prong holder, the at least two prongs each having an outer side respectively extended out of the opening in the inner cover shell and an inner side respectively fastened to the rotary prong holder, the at least two prongs including one center prong and at least one side prong, the inner side of the center prong being fastened to a center of rotation of the rotary prong holder, the inner side of each of the at least one side prong being fastened to the rotary prong holder and spaced from the center of rotation of the rotary prong holder at a different distance. At least one annular contact member is respectively mounted on one side of the rotary prong holder opposite to the opening in the inner cover shell and concentrically arranged around the center of rotation of the rotary prong holder and respectively electrically connected to the at least one side prong. And at least two connecting members are respectively affixed to the substrate, the number of the at least two connecting member being equal to the number of the at least two prongs, the at least two connecting members each having a connecting portion for the connection of an electric wire and a contact portion respectively disposed in contact with the inner side of the center prong and the at least one annular contact member.

According to an alternate form of the present invention, the rotary electrical plug comprises a housing having an inner cover shell, an outer cover shell abutted against the inner cover shell, a wire hole, an opening formed in the inner cover shell, and a substrate provided inside the outer cover shell; a rotary prong holder mounted inside the housing and rotatably coupled to the opening in the inner cover shell; at least two prongs respectively fastened to the rotary prong holder, the at least two prongs each having an outer side respectively extended out of the opening in the inner cover shell and an inner side respectively fastened to the rotary prong holder and spaced from the center of rotation of the rotary prong holder at a different distance; a plurality of annular contact members respectively mounted on one side of the rotary prong holder opposite to the opening in the inner cover shell and concentrically arranged around the center of rotation of the rotary prong holder and respectively electrically connected to the at least two prongs, the number of the annular contact members being equal to the number of the at least two prongs; and a plurality of connecting members respectively affixed to the substrate, the number of the connecting members being equal to the number of the at least two prongs, the connecting members each having a connecting portion for the connection of an electric wire and a contact portion respectively disposed in contact with the contact members.

DETAILED DESCRIPTION OF THE INVENTION

Referring to FIGS. 1~6, a rotatable electrical plug 1 in accordance with the first preferred embodiment of the present invention is shown comprised of a housing 10, a rotary prong holder 30, three prongs 40*a*, 40*b* and 40*c*, two contact members 50*a* and 50*b*, and three connecting members 60*a*, 60*b* and 60*c*.

Figure 1:
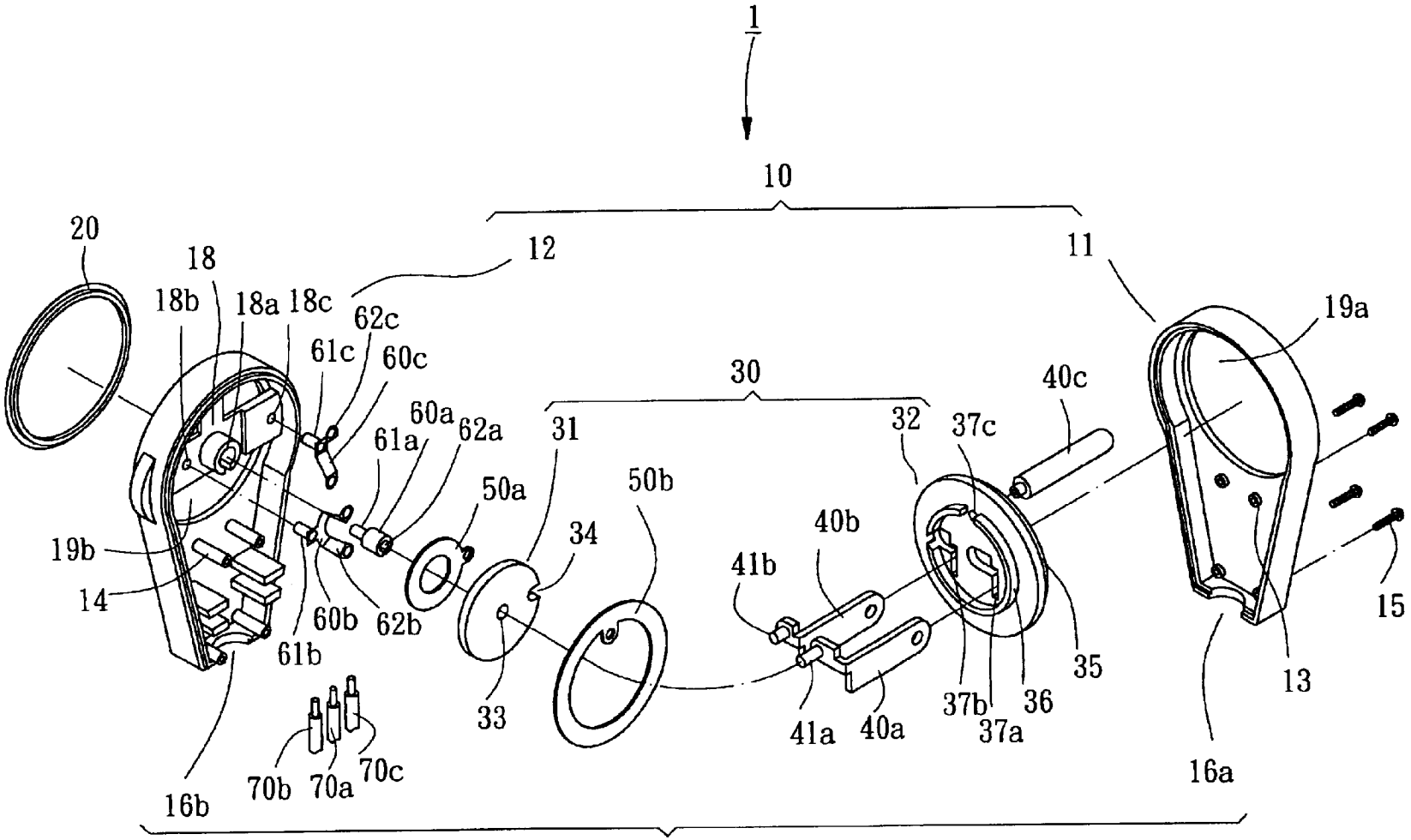
FIG. 1 is an exploded view of a rotatable electrical plug according to a first preferred embodiment of the present invention.
Figure 3:
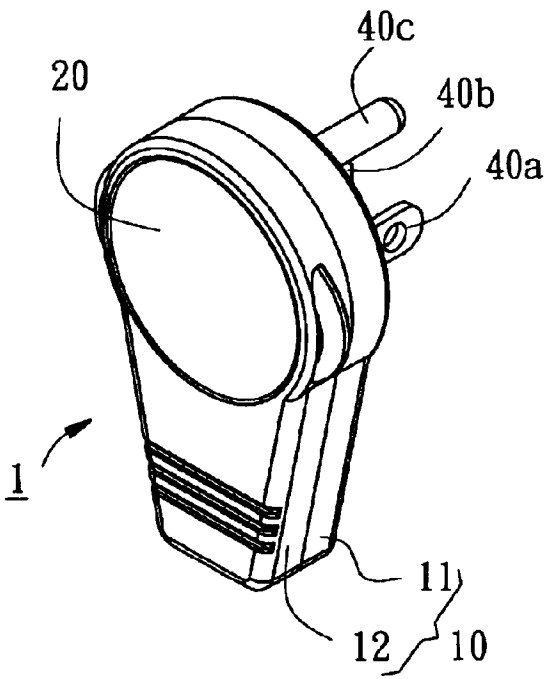
FIG. 3 is another perspective view of the rotatable electrical plug according to a first preferred embodiment of the present invention.
Figure 2:
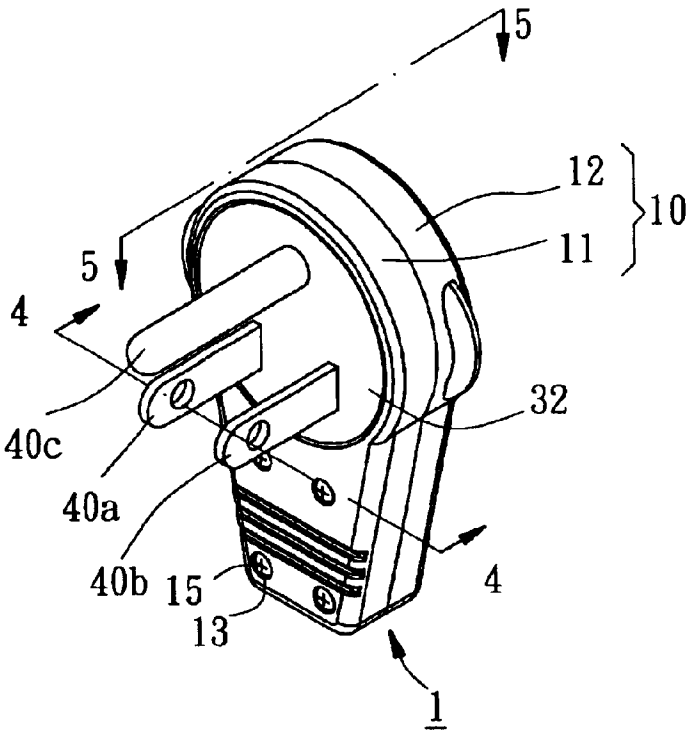
FIG. 2 is a perspective view of the rotatable electrical plug according to the first preferred embodiment of the present invention.

The housing 10 is comprised of an inner cover shell 11 and an outer cover shell 12. The cover shells 11 and 12 fit each other in shape, and are respectively molded from plastics. As illustrated in FIG. 1, the cover shells 11 and 12 each have a circular upper part, and a trapezoidal lower part, which has a width made gradually smaller from the circular upper part. Each cover shell 11 or 12 has a circular opening 19*a* or 19*b* in the circular upper part. The circular opening 19*b* of the outer cover shell 12 is closed by a cap 20. The inner cover shell 11 has four countersunk holes 13 in the trapezoidal lower part. The outer cover shell 12 has four female screws 14 perpendicularly extended from the trapezoidal lower part. Screws 15 are respectively mounted in the countersunk holes 13 and threaded into the female screws 14 to fixedly secure the cover shells 11 and 12 together. A substrate 18 is mounted in the circular upper part of the outer cover shell 12 and spaced from the circular opening 19*b* at a distance, having three mounting portions 18*a*, 18*b* and 18*c*. The cover shells 11 and 12 each further have a semicircular bottom notch 16*a* or 16*b* in the bottom side of the respective trapezoidal lower part. When the cover shells 11 and 12 fastened together, the semicircular bottom notch 16*a* and 16*b* form a circular wire hole 17 for the passing of electric wires 70*a*, 70*b* and 70*c* to the outside of the housing 10.

The rotary prong holder 30 is comprised of an upper holder plate 31 and a lower holder plate 32. The holder plates 31 and 32 are circular plate members respectively molded from plastics and arranged in a stack. The diameter of the upper holder plate 31 is smaller than the lower holder plate 32. The upper holder plate 31 has a circular through hole 33 through the center, and a notch 34 in the periphery. The diameter of the lower holder plate 32 is slightly greater than the circular opening 19*a* of the inner cover shell 11. The lower holder plate 32 has a coupling block 35 projected from one side, namely, the inner side and coupled to the circular opening 19*a* of the inner cover shell 11, an annular locating flange 36 projected from the other side, namely, the outer side and adapted to accommodate the upper holder plate 31 therein, and three through holes 37*a*, 37*b* and 37*c* extended through the inner and outer sides and the coupling block 35. The first and second through holes 37*a* and 37*b* are rectangular through holes. The third through hole 37*c* is a circular through hole. The rotary prong holder 30 is mounted inside the housing 10, and coupled to the circular opening 19*a* of the inner shell 11 with the coupling block 35 for free rotation relative to the housing 10.

The three prongs 40*a*, 40*b*, and 40*c* are fastened to the rotary prong holder 30. The first and second prongs 40*a* and 40*b* are substantially L-shaped metal plate members, each having a relatively longer and longitudinally extended front side and a relatively shorter and transversely extended rear side. The first and second prongs 40*a* and 40*b* each further has a cylindrical (or tubular) mounting legs 41*a* or 41*b* perpendicularly backwardly extended from the respective rear side. The first and second prongs 40*a* and 40*b* have the respective longer front sides respectively inserted through the rectangular first and second through holes 37*a* and 37*b* of the rotary prong holder 30 to the outside of the housing 10 and the respective shorter rear sides sandwiched in between the holder plates 31 and 32, keeping the mounting legs 41*a* and 41*b* respectively extended through the circular through hole 33 and notch 34 of the upper holder plate 31. The third prong 40*c* is metal round rod fastened to the circular third through hole 37*c* of the lower holder plate 32. After installation of the prongs 40*a*, 40*b*, and 40*c* in the rotary prong holder 30, the prongs 40*a*, 40*b*, and 40*c* have a part respectively extended out of the housing 10 through the circular opening 19*a* of the inner cover shell 11 for insertion into "hot slot", "neutral slot", and "ground slot" of a three-slot electrical socket (not shown).

The two contact members (first and second contact members) 50*a* and 50*b* are annular metal members concentrically mounted on the prong holder 30. The first contact member 50*a* is mounted on the upper holder plate 31 corresponding to the outer cover shell 12, and soldered to the mounting leg 41*b* of the second prong 40*b* (keeping the upper holder plate 31 and the lower holder plate 32 fixedly secured together). The second contact member 50*b* is mounted on the lower holder plate 31 corresponding to the outer cover shell 12, and soldered to the third prong 40*c*.

The three connecting members (first, second and third connecting members) 60*a*, 60*b*, and 60*c* are metal members, each having a tubular connecting portion 61*a*, 61*b*, or 61*c* respectively connected to the mounting portions 18*a*, 18*b*, and 18*c* of the substrate 18, and a contact portion 62*a*, 62*b*, or 62*c*. The contact portion 62*a* of the first connecting member 60*a* is shaped like an open barrel and sleeved onto the mounting leg 41*a* of the first prong 40*a*. The contact portions 62*b* and 62*c* of the second and third connecting members 60*b* and 60*c* are spring strips respectively pressed on the first and second contact members 50*a* and 50*b*.

According to the aforesaid arrangement, the contact members 50*a* and 50*b* are concentrically arranged around the cylindrical mounting leg 41*a* of the first prong 40*a*, therefore the first connecting member 60*a* is constantly maintained in close contact with the first prong 40*a*, and the second and third connecting members 60*b* and 60*c* are respectively constantly maintained in close contact with the contact members 50*a* and 50*b* when rotating the rotary prong holder 30 relative of the housing 10 to any desired angle.

The rotatable electrical plug 1 of the aforesaid first embodiment of the present invention can be used as a three-prong plug for a conventional electric appliance. When connecting to a power cord, the three electric wires (neutral wire, hot wire, and grounding wire) 70*a*, 70*b*, and 70*c* are soldered to the connecting portions 61*a*, 61*b*, and 61*c* of the connecting members 60*a*, 60*b*, and 60*c*. The electric wires 70*a*, 70*b*, and 70*c* are set at the back side of the substrate 18 (in the gap between the substrate 18 and the circular opening 19*b* of the outer cover shell 12), and extended out of the housing 10 through the wire hole 17.

When in use, insert the prongs 40*a*, 40*b*, and 40*c* into the hot, neutral, and ground slots of a three-slot electrical socket, for enabling electric current to pass through the contact members 50*a* and 50*b* and the connecting members 60*a*, 60*b*, and 60*c* to the electric appliance via the power cord. Because the prongs 40*a*, 40*b*, and 40*c* are affixed to the rotary prong holder 30, the rotary prong holder 30 is firmly secured to the electrical socket when rotating the housing 10 of the rotatable electrical plug 1, and rotating the housing 10 relative to the rotary prong holder 30 does not interfere with the transmission of electricity from the electrical socket to the electric appliance. Therefore, when changing the position of the electric appliance, the housing 10 of the rotatable electrical plug 1 can be biased to the corresponding angle without distorting the power cord. Therefore, the invention greatly prolongs the service life of the product, and ensures the safety of the use of electric appliance.

The main features of the aforesaid first embodiment of the present invention are as follows:

1. The three connecting members 60*a*, 60*b*, and 60*c* are respectively connected to the three wires of the power cord to hold the electric wires of the power cord in place and to electrically connect the power cord to the contact members 50*a* and 50*b*, which are respectively connected to the second and third prongs 40*b* and 40*c* at the rotary prong holder 30. Because of the structure of the rotatable electrical plug 1 is simple and its installation procedure is easy, the manufacturing cost of the rotatable electrical plug 1 is low.
2. A backward displacement of the prongs 40*a*, 40*b*, and 40*c* may distort internal members of the rotatable electrical plug 1, causing a false connection. The upper and lower holder plates 31 and 32 of the rotary prong holder 30 hold the short sides of the first and second prongs 40*a* and 40*b* firmly in place, preventing backward displacement of the prongs 40*a*, 40*b*, and 40*c* upon accidental contact of an external hard body.
3. After opening of the cap 20 from the outer cover shell 12, the user can visually check the connection status between the electric wires 70*a*, 70*b*, and 70*c* and the connecting members 60*a*, 60*b*, and 60*c* at the substrate 18 through the circular opening 19*b* of the outer cover shell 12, and repair or replace the members of the circuit.

Figure 8:
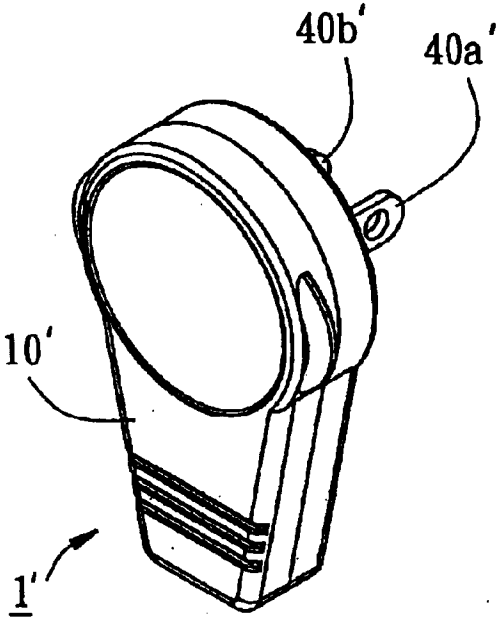
FIG. 8 is a perspective of the rotatable electrical plug according to the second preferred embodiment of the present invention.
Figure 4:
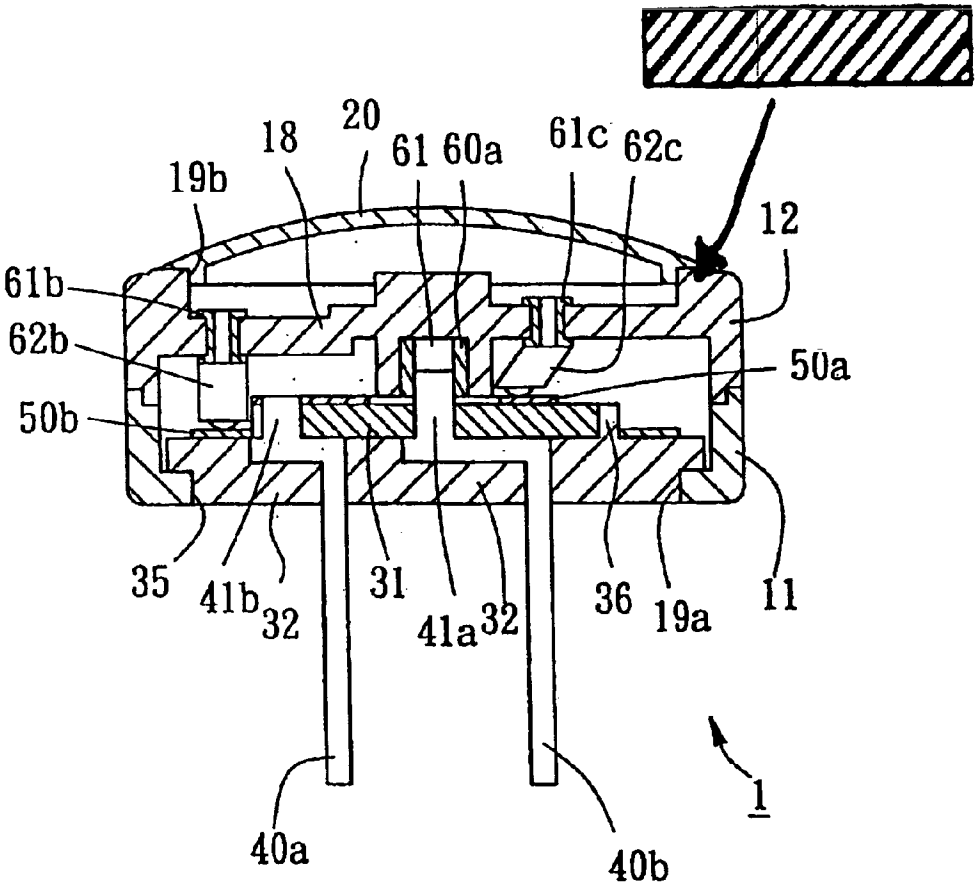
FIG. 4 is a sectional view, in an enlarged scale, taken along line 4—4 of FIG. 2.
Figure 6:
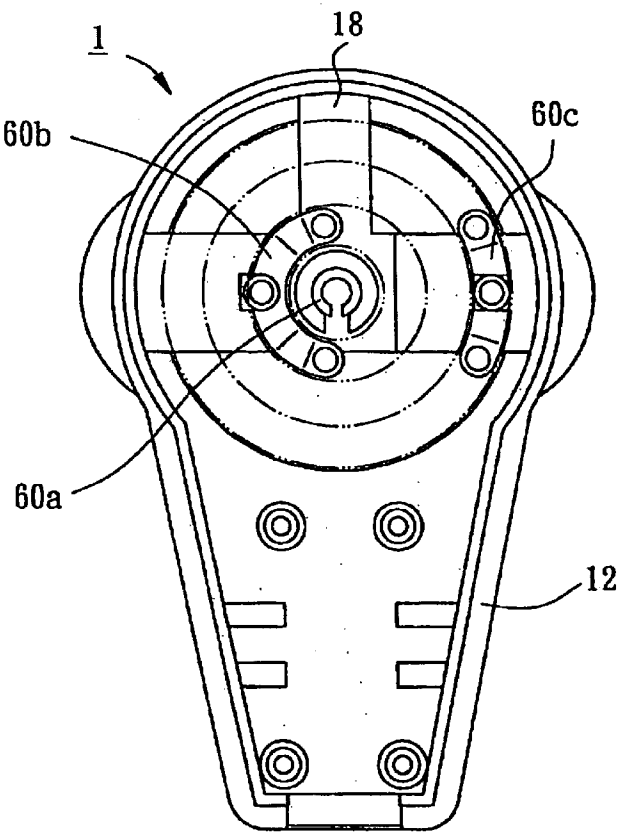
FIG. 6 is a top plain view in an enlarged scale of the rotatable electrical plug according to the first preferred embodiment of the present invention after removal of the outer cover shell.
Figure 5:
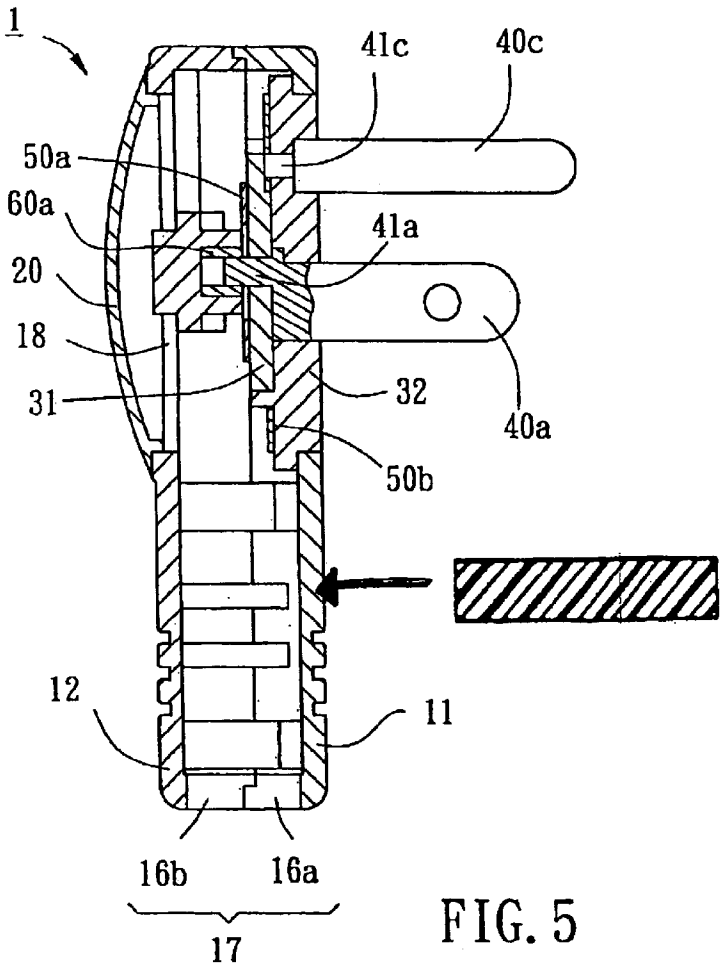
FIG. 5 is a sectional view, in an enlarged scale, taken along line 5—5 of FIG. 2.
Figure 7:
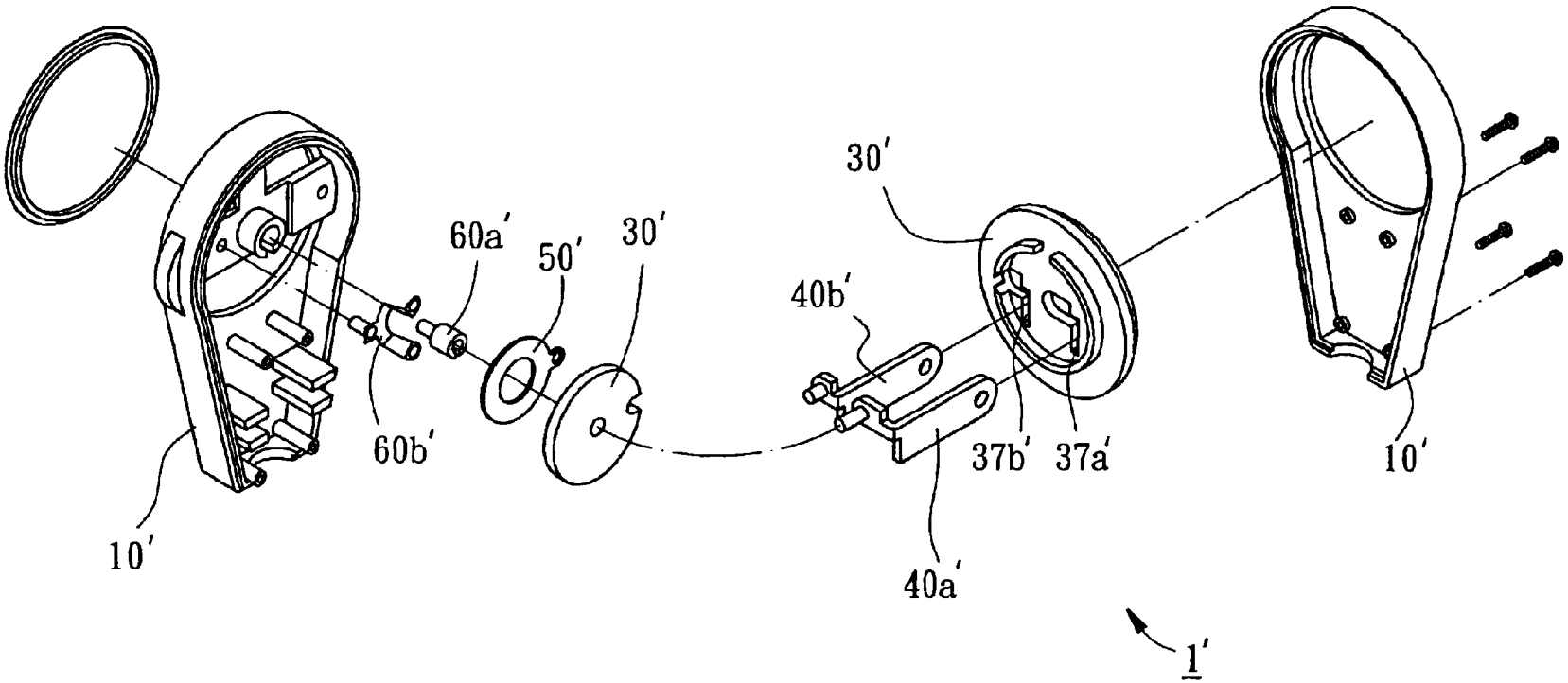
FIG. 7 is an exploded view of a rotatable electrical plug according to a second preferred embodiment of the present invention.

FIGS. 7 and 8 show a rotatable electrical plug 1' according to the second embodiment of the present invention. According to this embodiment, the rotatable electrical plug 1' is a two-prong electrical plug for connection to a two-slot electrical socket, comprised of a housing 10', which is identical to the housing 10 of the aforesaid first embodiment of the present invention, a rotary prong holder 30', which is substantially similar to the rotary prong holder 30 of the aforesaid first embodiment of the present invention with the exception of having only two through holes 37*a*' and 37*b*'), two prongs (first and second prongs) 40*a*' and 40*b*', which are similar to the first and second prongs 40*a* and 40*b* of the aforesaid first embodiment of the present invention and respectively fastened to the through holes 37*a*' and 37*b*' of the rotary prong holder 30 for insertion into the hot and neutral slots of a two-slot electrical socket, a contact member 50', which is similar to the first contact member 50 of the aforesaid first embodiment of the present invention, for connection to the second prong 40*b*' electrically, and two connecting members 60*a*' and 60*b*' respectively connected to the first prong 40*a*' and disposed in contact with the contact member 50'. In general, this embodiment uses two prongs to substitute for the three prongs of the aforesaid first embodiment. Mainly, the second embodiment has the rotary prong holder 30' made in a circular shape and, eliminates the grounding third prongs, grounding third contact member and grounding third connecting member as used in the aforesaid first embodiment of the present invention.

Further, it is to be understood that the mounting leg of the first prong according to the second embodiment of the present invention is fastened to the center of the rotary prong holder. Therefore, one contact member is sufficient, and the mounting leg of the first prong is directly pivoted to the first connecting member. In actual practice, two contact members may be used and respectively connected to the prongs for the contact of respective spring strip-like contact portions of the connecting members respectively.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A rotatable electrical plug comprising:

a housing having an inner cover shell, an outer cover shell abutted against said inner cover shell, a wire hole, an opening formed in said inner cover shell, and a substrate provided inside said outer cover shell;

a rotary prong holder mounted inside said housing and rotatably coupled to the opening in said inner cover shell;

at least two prongs respectively fastened to said rotary prong holder, said at least two prongs each having an outer side respectively extended out of the opening in said inner cover shell and an inner side respectively fastened to said rotary prong holder, said at least two prongs including one center prong and at least one side prong, the inner side of said center prong being fastened to a center of rotation of said rotary prong holder, the inner side of each of said at least one side prong being fastened to said rotary prong holder and spaced from the center of rotation of said rotary prong holder at a different distance;

at least one annular contact member respectively mounted on one side of said rotary prong holder opposite to the opening in said inner cover shell and concentrically arranged around the center of rotation of said rotary prong holder and respectively electrically connected to said at least one side prong;

a first connecting member and a second member of at least two connecting members affixed to said substrate, the number of said at least two connecting members being equal to the number of said at least two prongs, said at least two connecting members each having a connecting portion for the connection of an electric wire and the first connecting member having a contact portion disposed in contact with the inner side of said center prong and the second connecting member having a contact portion disposed with the at least one annular contact member;

wherein said at least two prongs are substantially L-shaped flat metal plate members each having a respective outer side made relatively longer than a respective inner side and a mounting leg extended from the respective inner side; and wherein said rotary prong holder comprises an upper holder plate and a lower holder plate arranged in a stack, said lower holder plate having a plurality of through holes for the mounting of the inner sides of said at least two prongs respectively and an annular flange projecting from one side thereof and adapted to accommodate said upper holder plate, said upper holder plate having a plurality of through holes, the number of the through holes of said upper holder plate being less one with respect to the through holes of said lower holder plate, one of the through holes of said upper holder plate extending through the center of said upper holder plate; said at least two prongs each have the respective longer outer sides extended through the through holes of said lower holder plate to the outside of said rotary prong holder and the respective shorter inner sides sandwiched in between said upper holder plate and said lower holder plate and the respective mounting legs respectively extended out of the through holes of said upper holder plate.

2. The rotatable electrical plug as claimed in claim 1, wherein the inner side of said center prong has a cylindrical shape.

3. The rotatable electrical plug as claimed in claim 1, wherein the inner side of said center prong has a tubular shape.

4. The rotatable electrical plug as claimed in claim 1, wherein said at least two prongs are substantially L-shaped flat metal plate members each having a respective outer side made relatively longer than a respective inner side and a mounting leg extended from the respective inner side.

5. The rotatable electrical plug as claimed in claim 4, wherein said rotary prong holder comprises an upper holder plate and a lower holder plate arranged in a stack, said lower holder plate having a plurality of through holes for the mounting of the inner sides of said at least two prongs respectively and an annular flange projecting from one side thereof and adapted to accommodate said upper holder plate, said upper holder plate having a plurality of through holes, the number of the through holes of said upper holder plate being less one with respect to the through holes of said lower holder plate, one of the through holes of said upper holder plate extending through the center of said upper holder plate; said at least two prongs each have the respective longer outer sides extended through the through holes of said lower holder plate to the outside of said rotary prong holder and the respective shorter inner sides sandwiched in between said upper holder plate and said lower holder plate and the respective mounting legs respectively extended out of the through holes of said upper holder plate.

6. The rotatable electrical plug as claimed in claim 1, wherein said outer cover plate has an opening and a detachable cap fastened to the opening of said outer cover plate; said substrate is mounted in said outer cover plate and spaced from the opening of said outer cover plate at a distance for receiving the electric wires therebetween.

7. A rotatable electrical plug comprising:

a housing having an inner cover shell, an outer cover shell abutted against said inner cover shell, a wire hole, an opening formed in said inner cover shell, and a substrate provided inside said outer cover shell;

a rotary prong holder mounted inside said housing and rotatably coupled to the opening in said inner cover shell;

at least two prongs respectively fastened to said rotary prong holder, said at least two prongs each having an outer side respectively extended out of the opening in said inner cover shell and an inner side respectively fastened to said rotary prong holder and spaced from a center of rotation of said rotary prong holder at a different distance;

a plurality of annular contact members respectively mounted on one side of said rotary prong holder opposite to the opening in said inner cover shell and concentrically arranged around the center of rotation of said rotary prong holder and respectively electrically connected to said at least two prongs, the number of said annular contact members being equal to the number of said at least two prongs; and a plurality of connecting members respectively affixed to said substrate, the number of said connecting members being equal to the number of said at least two prongs, said connecting members each having a connecting portion for the connection of an electric wire and a contact portion respectively disposed in contact with said contact members;

wherein said at least two prongs are substantially L-shaped flat metal plate members each having a respective outer side made relatively longer than a respective inner side and a mounting leg extended from the respective inner side;

wherein said rotary prong holder comprises an upper holder plate and a lower holder plate arranged in a stack, said lower holder plate having a plurality of through holes for the mounting of the inner sides of said at least two prongs respectively and an annular flange projecting from one side thereof and adapted to accommodate said upper holder plate, said upper holder plate having a plurality of through holes, the number of the through holes of said upper holder plate being less one with respect to the through holes of said lower holder plate; said at least two prongs each have the respective longer outer sides extended through the through holes of said lower holder plate to the outside of said rotary prong holder and the respective shorter inner sides sandwiched in between said upper holder plate and said lower holder plate and the respective mounting legs respectively extended out of the through holes of said upper holder plate.

8. The rotatable electrical plug as claimed in claim 1, wherein said at least two prongs are substantially L-shaped flat metal plate members each having a respective outer side made relatively longer than a respective inner side and a mounting leg extended from the respective inner side.

9. The rotatable electrical plug as claimed in claim 8, wherein said rotary prong holder comprises an upper holder plate and a lower holder plate arranged in a stack, said lower holder plate having a plurality of through holes for the mounting of the inner sides of said at least two prongs respectively and an annular flange projecting from one side thereof and adapted to accommodate said upper holder plate, said upper holder plate having a plurality of through holes, the number of the through holes of said upper holder plate being less one with respect to the through holes of said lower holder plate; said at least two prongs each have the respective longer outer sides extended through the through holes of said lower holder plate to the outside of said rotary prong holder and the respective shorter inner sides sandwiched in between said upper holder plate and said lower holder plate and the respective mounting legs respectively extended out of the through holes of said upper holder plate.

10. The rotatable electrical plug as claimed in claim 7, wherein said outer cover plate has an opening and a detachable cap fastened to the opening of said outer cover plate; said substrate is mounted in said outer cover plate and spaced from the opening of said outer cover plate at a distance for receiving the electric wires therein.

11. A rotatable electrical plug comprising:

a housing having an inner cover shell, an outer cover shell abutted against said inner cover shell, a wire hole, an opening formed in said inner cover shell, and a substrate provided inside said outer cover shell;

a rotary prong holder mounted inside said housing and rotatably coupled to the opening in said inner cover shell;

at least two prongs respectively fastened to said rotary prong holder, said at least two prongs each having an outer side respectively extended out of the opening in said inner cover shell and an inner side respectively fastened to said rotary prong holder, said at least two prongs including one center prong and at least one side prong, the inner side of said center prong being fastened to a center of rotation of said rotary prong holder, the inner side of each of said at least one side prong being fastened to said rotary prong holder and spaced from the center of rotation of said rotary prong holder at a different distance;

at least one annular contact member respectively mounted on one side of said rotary prong holder opposite to the opening in said inner cover shell and concentrically arranged around the center of rotation of said rotary prong holder and respectively electrically connected to said at least one side prong;

a first connecting member and a second member at least two connecting members affixed to said substrate, the number of said at least two connecting members being equal to the number of said at least two prongs, said at least two connecting members each having a connecting portion for the connection of an electric wire and the first connecting member having a contact portion disposed in contact with the inner side of said center prong and the second connecting member having a contact portion disposed with the at least one annular contact member; and wherein said outer cover plate has an opening and a detachable cap fastened to the opening of said outer cover plate; said substrate is mounted in said outer cover plate and spaced from the opening of said outer cover plate at a distance for receiving the electric wires therebetween.

12. The rotatable electrical plug as claimed in claim 11, wherein the inner side of said center prong has a cylindrical shape.

13. The rotatable electrical plug as claimed in claim 11, wherein the inner side of said center prong has a tubular shape.

14. The rotatable electrical plug as claimed in claim 11, wherein said at least two prongs are substantially L-shaped flat metal plate members each having a respective outer side made relatively longer than a respective inner side and a mounting leg extended from the respective inner side.

15. A rotatable electrical plug comprising:

a housing having an inner cover shell, an outer cover shell abutted against said inner cover shell, a wire hole, an opening formed in said inner cover shell, and a substrate provided inside said outer cover shell;

a rotary prong holder mounted inside said housing and rotatably coupled to the opening in said inner cover shell;

at least two prongs respectively fastened to said rotary prong holder, said at least two prongs each having an outer side respectively extended out of the opening in said inner cover shell and an inner side respectively fastened to said rotary prong holder, said at least two prongs including one center prong and at least one side prong, the inner side of said center prong being fastened to a center of rotation of said rotary prong holder, the inner side of each of said at least one side prong being fastened to said rotary prong holder and spaced from the center of rotation of said rotary prong holder at a different distance;

at least one annular contact member respectively mounted on one side of said rotary prong holder opposite to the opening in said inner cover shell and concentrically arranged around the center of rotation of said rotary prong holder and respectively electrically connected to said at least one side prong;

a first connecting member and a second member of at least two connecting members affixed to said substrate, the number of said at least two connecting members being equal to the number of said at least two prongs, said at least two connecting members each having a connecting portion for the connection of an electric wire and the first connecting member having a contact portion disposed in contact with the inner side of said center prong and the second connecting member having a contact portion disposed with the at least one annular contact member; and wherein said outer cover plate has an opening and a detachable cap fastened to the opening of said outer cover plate; said substrate is mounted in said outer cover plate and spaced from the opening of said outer cover plate at a distance for receiving the electric wires therein.

* * * * *